United States Patent [19]

Ustin et al.

[11] Patent Number: 4,461,523

[45] Date of Patent: Jul. 24, 1984

[54] PROTECTIVE LAMPHOLDER FOR BAYONET BASE LAMP

[75] Inventors: George Ustin, Croton-on-Hudson; Andrew P. Soltis, Yonkers, both of N.Y.

[73] Assignee: North American Philips Corporation, New York, N.Y.

[21] Appl. No.: 326,242

[22] Filed: Dec. 1, 1981

[51] Int. Cl.[3] ..... H01R 13/625

[52] U.S. Cl. ..... 339/41; 339/42; 339/88 R; 339/188 R

[58] Field of Search ..... 339/88 R, 88 C, 188 R, 339/188 C, 188 T, 40, 41, 42

[56] References Cited

U.S. PATENT DOCUMENTS

| | | | |
|---|---|---|---|
| 1,249,711 | 12/1917 | Berg | 339/188 R |
| 2,470,280 | 5/1949 | Ackerman | 339/188 R |

FOREIGN PATENT DOCUMENTS

| | | | |
|---|---|---|---|
| 2337954 | 8/1977 | France | 339/41 |
| 2403665 | 4/1979 | France | 339/41 |
| 139469 | 5/1921 | United Kingdom | 339/188 R |

*Primary Examiner*—John McQuade

*Attorney, Agent, or Firm*—Robert J. Kraus

[57] ABSTRACT

A protective lampholder for a bayonet base lamp includes an insulating cup interposed between the base of the lamp and contacts provided in the lampholder for supplying power to the lamp. The cup covers the contacts when the lamp is removed, but exposes them when the lamp is inserted and rotated to an operating position.

4 Claims, 8 Drawing Figures

PROTECTIVE LAMPHOLDER FOR BAYONET BASE LAMP

BACKGROUND OF THE INVENTION

This invention relates to a lampholder for a bayonet base lamp. Such a lampholder comprises a body including a hollow portion at one end for receiving the lamp base and a support portion at the other end. The hollow portion has means such as indentations formed in opposite sides of its inner wall for receiving pins projecting from opposite sides of the lamp base when it is inserted into the lampholder body. The indentations permit rotation of the lamp base to an operating position at which it is held in the lampholder. At this position electrical contacts on the bottom of the lamp base make connection with electrical contacts mounted in the support portion of the lamp holder body for supplying power to the lamp.

Conventional lampholders of the above-described type present a potential shock hazard because the electrical contacts in the lampholder are exposed whenever the lamp is removed. This shock hazard is especially great when the lampholder is used with gaseous discharge lamps, which are sometimes operated at voltages above 250 volts. To protect against this hazard it is desirable to provide means for preventing a person from inadvertently touching or otherwise making electrical connection with the lampholder contacts when the lamp is removed. Although it is known to provide convenience outlets with pivoting covers, the protective function of these covers can be easily defeated. It is also known, from U.S. Pat. No. 4,139,252, to provide a protective device for preventing a person from touching electrical contacts of a rotatable-connection plug which can be inserted into a live current rail. The plug includes a screening element of insulating material which is rotatable relative to the contacts of the plug and which bars user access to the contacts when they engage the current rail. This protective device provides protection when the plug is being inserted or removed from the rail, but does not provide any protection against shock when no plug is in the current rail.

SUMMARY OF THE INVENTION

An object of the invention is to provide a protective lampholder having automatic protective means which does not interfere with normal operation of the lampholder.

Another object of the invention is to provide a protective lampholder which is easily assembled, but in which the protective means cannot be easily removed by a user.

In accordance with the invention a rotatable insulating member provided in the lampholder covers the lampholder contacts when the lamp is removed, but rotates to a position at which the contacts are uncovered after a lamp base is inserted and rotated to the operating position.

In a preferred embodiment of the invention, this member comprises an insulator cup, rotatably mounted in the lampholder for interposition between a lamp base inserted in the lampholder and the body of the lampholder. Slots are provided in opposite sides of the insulator cup for receiving the pins of the lamp base and for effecting rotation of the cup with the base. Apertures formed in the bottom of the cup always align with the contacts on the inserted base, but only align with the contacts mounted in the support portion of the lampholder body when the base is rotated to the operating position. The lampholder contacts are resiliently loaded toward an open end of the hollow portion so that they move into the apertures and are firmly biased against the lamp base contacts upon completion of cup rotation. Thus the lampholder contacts are only exposed when a lamp is held in the lampholder.

In this embodiment, the insulator cup is retained in the hollow portion of the lampholder body by inwardly-protruding retaining stops provided at the open end of the body. The cup is urged against these retaining stops by a resiliently-loaded guide plate positioned in the lampholder body between the cup and the support portion of the body. This guide plate includes apertures to allow passage of the resiliently-loaded contacts through the plate.

In addition to rotational movement, longitudinal movement of the insulator cup is desirable to facilitate locking of the lamp base in the lampholder body. In the preferred embodiment, the lampholder is adapted for such movement by providing radially-extending tabs on opposite sides of the cup for projecting into the indentations in the inner wall of the lampholder body and by forming the indentations such that they allow both rotational and longitudinal movement.

Assembly of the lampholder during manufacture can be simplified by inserting all of its component parts through the open end of the hollow portion. With the exception of the insulator cup, which must be held in the body by the retaining stops, all of the parts can be made with diameters smaller than the distance between these stops. Insertion of the cup itself can be facilitated by making the cup flexible at the portions of its sidewall which must pass by the retaining stops. Once the cup is installed in the lampholder body it cannot be easily removed because the sidewalls are no longer sufficiently accessible to enable the flexing that would be required to clear the retaining stops.

DESCRIPTION OF THE PREFERRED EMBODIMENT

Figure 1:
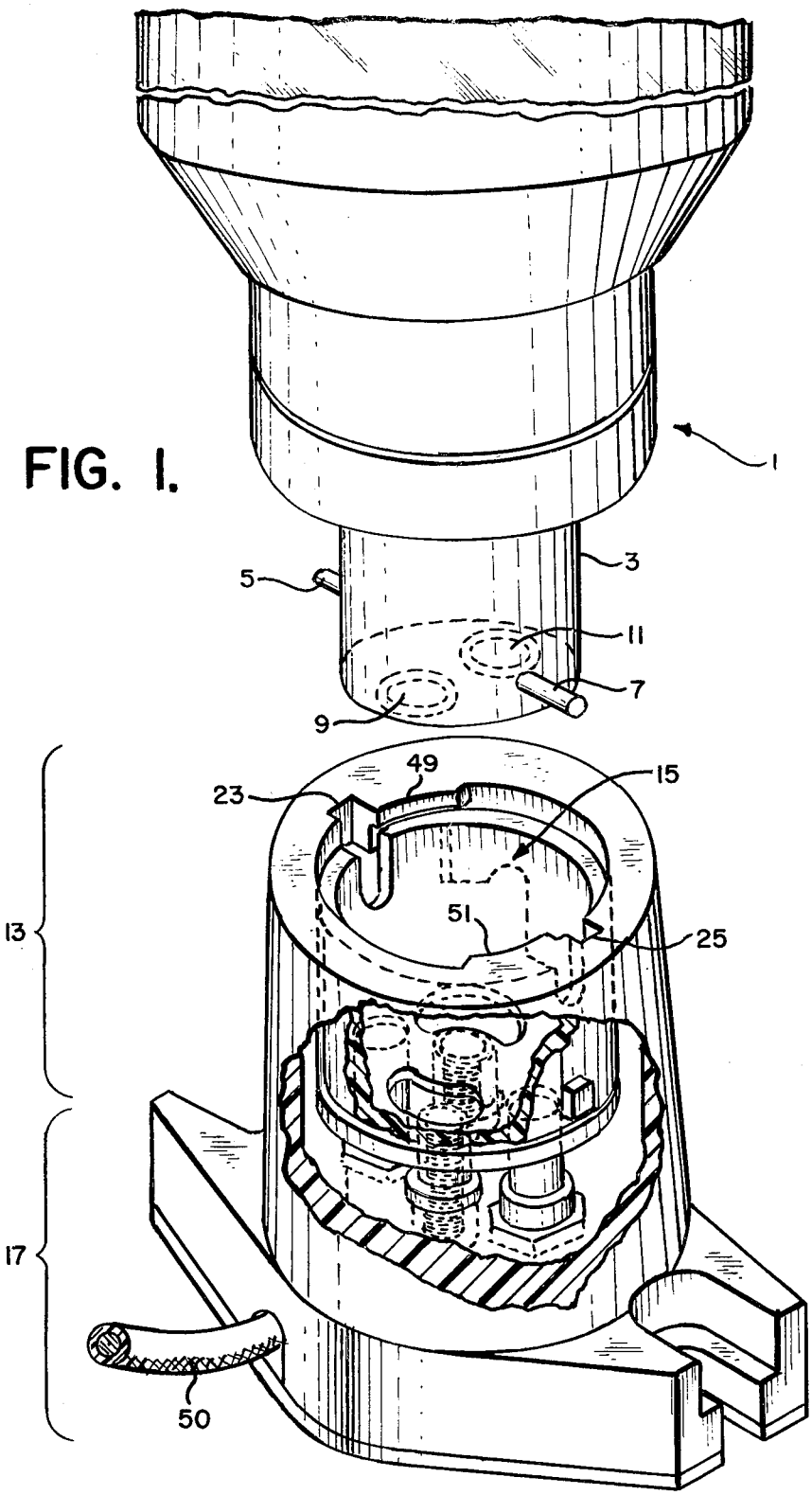
FIG. 1 is a perspective view of a preferred embodiment of the protective lampholder with its sidewall partly cut away, and of the bayonet base of a lamp aligned for insertion into the lampholder.
Figure 2:
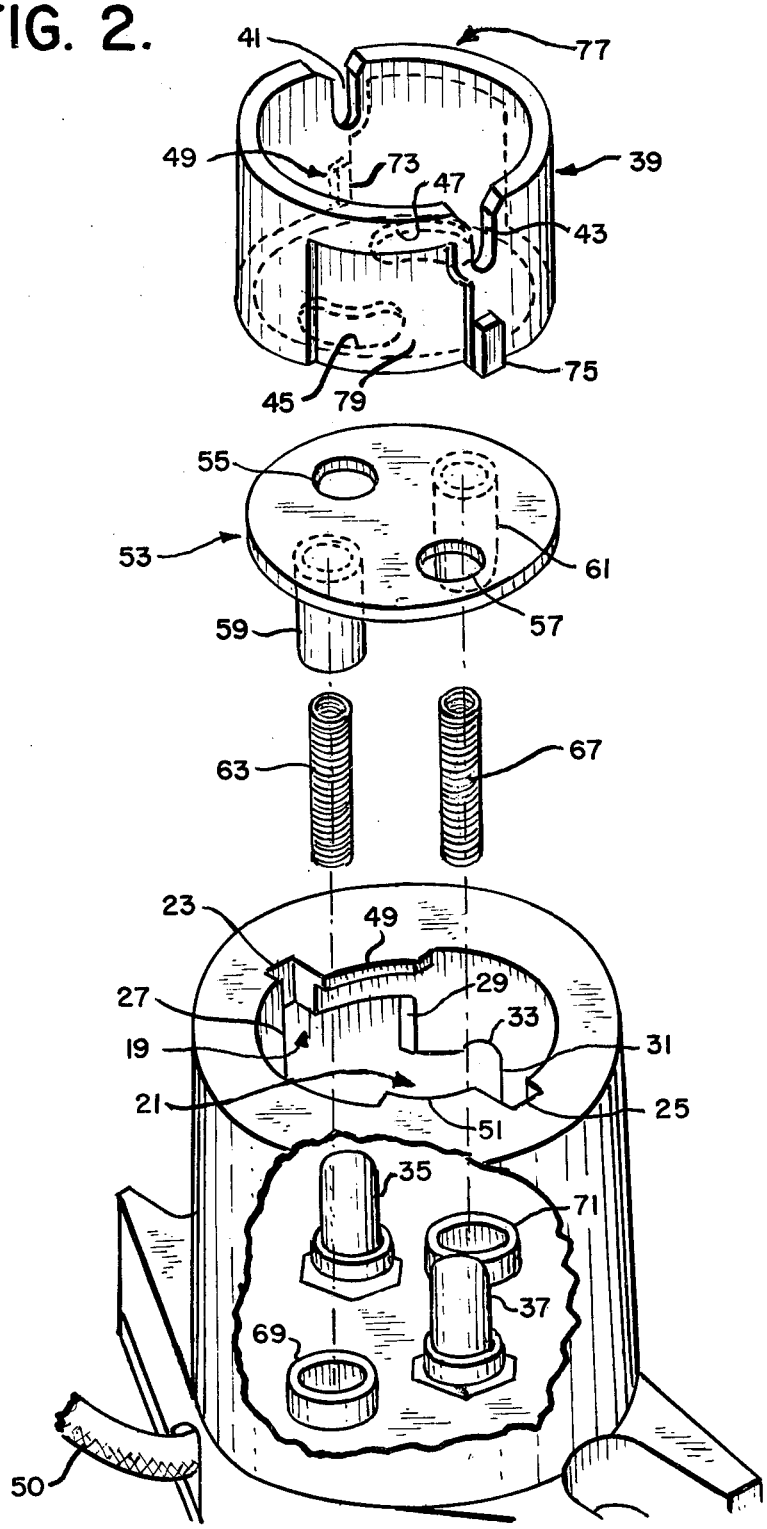
FIG. 2 is an exploded view of the component parts of the lampholder of FIG. 1.

Referring to FIGS. 1 and 2, an exemplary lampholder embodying the invention for use with a lamp 1 is illustrated in detail. The lamp 1 includes an insulating bayonet base 3 having pins 5, 7 protruding from opposite sides and having electrical contacts 9, 11 provided on the bottom.

The lampholder comprises a body having a hollow portion 13 with an opening 15 at one end for receiving the lamp base 3, and a support portion 17 at the opposite end. The inner wall of hollow portion 13 has identical indentations 19, 21 formed in opposite sides thereof. The indentations 19, 21 include slots 23, 25 for receiving respective pins 5, 7 of the lamp base 3. The edges of the indentations form integral guiding surfaces for guiding the pins of the lamp base in the lampholder body as the lamp is rotated between a first position at which it can be inserted into or removed from the lampholder, and a second or operating position at which it is held in the lampholder. These guiding surfaces are shown for the indentation 19 as including stops 27, 29, 31 and holding detent 33. Identical guiding surfaces (not shown) are formed by the edges of indentation 21 for guiding pin 7.

In accordance with the invention electrical contacts 35, 37, provided in the support portion of the lampholder for supplying electrical power to an inserted lamp, are covered when no lamp is held in the lampholder, thus protecting a person against electrical shock by preventing inadvertent touching of these electrical contacts.

Figure 3:
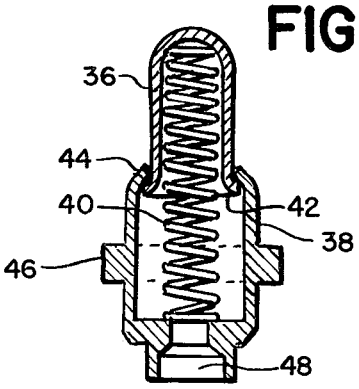
FIG. 3 is a detailed cross-sectional view of an electrical contact utilized in the lampholder of FIGS. 1 and 2.

An exemplary embodiment of one of these lampholder contacts, which are resiliently loaded toward the opening 15, is illustrated in detail in FIG. 3. The contacts each comprise a hollow contact element 36, a generally tubular member 38 and a spring 40. A flared end 42 of the contact element is retained within an inwardly-directed end 44 of the tubular member, against the expansion force of the spring 40 retained within the contact. An outwardly-extending flange 46 of the member 38 mates with a hole in the support portion 17 of the lampholder. Both the flange 46 and the hole are hexagonally-shaped to prevent rotation of the flange relative to the support portion 17, which would be undesireable after a power supplying conductor is attached to the contact element 36. An opening 48 in the bottom of member 38 receives the conductor, which is brought into the support portion of the lampholder body as part of a multiconductor power cord 50.

The contacts 35, 37 are covered, to protect against electrical shock, by an insulator cup 39 which is rotatably mounted in the hollow portion of the lampholder body. Slots 41, 43 are provided in opposite sides of the cup for receiving and engaging the respective pins 5, 7 of the lamp base 3 to effect rotation of the cup 39 with the base. The corners of the slots 41, 43 may be bevelled as shown in FIG. 2 to facilitate entry of the pins, but such bevelling is not necessary. As shown in FIG. 1, the contacts are covered by the bottom of the cup when the slots 41, 43 are aligned with the slots 23, 25 in the body 13. Two apertures 45, 47, formed in the bottom of the cup align with the contacts 9, 11 of an inserted lamp. When the lamp base 3 is inserted into the lampholder, the cup 39 is interposed between the base 3 and the hollow portion 13.

The insulating cup 39 is retained in the hollow portion 13 by inwardly protruding retaining stops 49, 51 formed as integral parts of the lampholder body at its open end. These stops project part way across the rim at the open end of the cup, thus securing it within the body. The cup is urged against these retaining stops by a resiliently-loaded guide plate 53 located between the bottom of the cup and an inner surface of the support portion 17 which communicates with the interior of hollow portion 13. Apertures 55, 57 in the guide plate align with the respective contacts 35, 37 which pass through these apertures to the base of the insulator cup 39. The guide plate has tubular spring guides 59, 61 for containing ends of respective springs 63, 67 which provide the resilient force urging the insulating cup 39 against the retaining stops 49, 51. The opposite ends of these springs and the open ends of the tubular spring guides are disposed in respective holes 69, 71 in the support portion 17.

Rotational movement of the insulator cup 39 is limited by the edges of the indentations 19, 21 in cooperation with radially extending tabs 73, 75 provided on opposite sides of the cup. These tabs project into their respective indentations which limit rotation of the cup between a first or lamp inserting/removing positon where the tab 73 abuts stop 27, and a second or lamp holding or operating poistion where tab 73 abuts stop 31. Tab 75 abuts the corresponding stops (not shown) in indentation 21 at these two positions. Longitudinal movement of the cup is also allowed by the tabs and indentations to permit lamp base 3 to be pressed into the body 13 far enough for its pin 5 to clear the stop 29 as it is rotated to the holding detent 33. As previously mentioned, a corresponding stop and detent (not shown) are provided for pin 7.

During assembly of the lampholder, all of the components are inserted through the opening 15. All components but the cup 39 are dimensioned to pass freely by the retaining stops 49, 51. Portions of the sidewall of the cup are thinned by removing material from the outer surface thereof at 77, 79 to enable passage by the respective retaining stops 49, 51. The cup's wall near the rim is not thinned, but this portion of the cup wall is flexible because of the removed portions. The sidewall must be pressed inwardly at these locations during installation of the cup through opening 15, to clear the stops. After installation, the sidewall springs back to its natural shape and the cup is retained within the lampholder, also holding the other components in place.

Figure 4A:
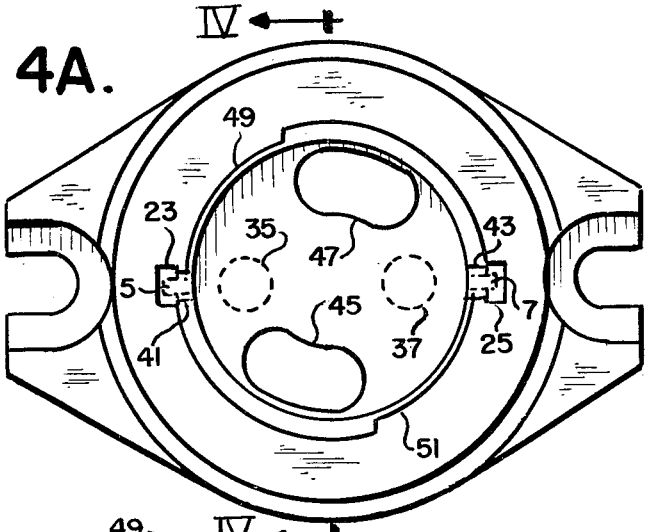
FIGS. 4*a*, 4*b*, 4*c* show a top view, a front view partially cut-away and a side view in section of the protective lampholder of FIGS. 1 and 2 with the insulator cup positioned to protect against electrical shock when the lamp is removed.
Figure 4B:
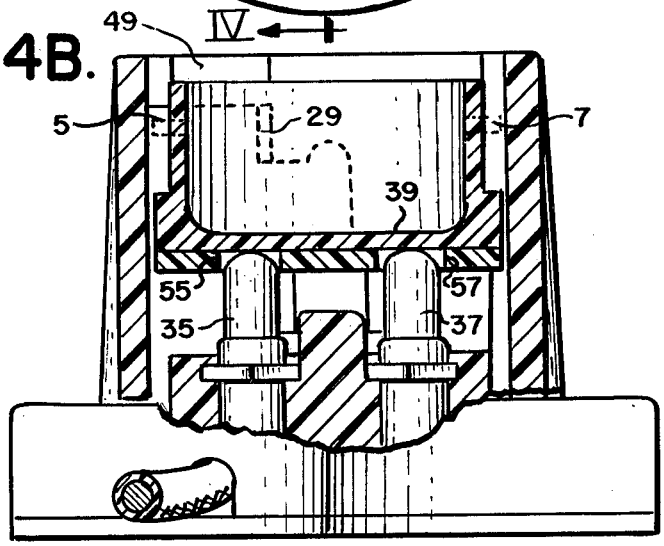
Figure 4C:
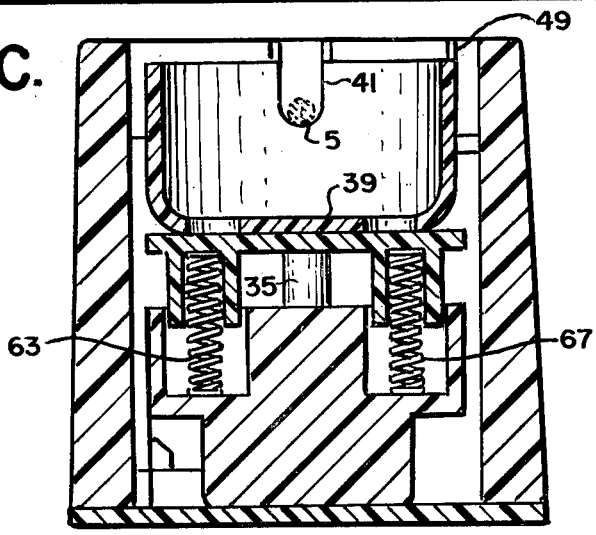

Operation of the lampholder during insertion of a lamp is illustrated in FIGS. 4*a*, 4*b*, 4*c*, 5*a* and 5*b*. All components of the lampholder are shown in these figures, but only the pins 5, 7 of the inserted lamp are shown, in phantom. In FIGS. 4*a*, 4*b*, 4*c* the components of the lampholder are shown in the first position, after a lamp base has been inserted. The pins 5, 7 sit in cup slots 41, 43 and extend into body slots 23, 25 (FIG. 4*a*). The resiliently loaded contacts 35, 37 press against the bottom of cup 39 through guide plate openings 55, 57 (FIG. 4*b*). The springs 63, 67 force the guide plate against the bottom of the cup, thus urging the rim of the cup against retaining stops 49, 51 (FIG. 4*c*).

After the lamp base is inserted into the hollow portion of the lampholder body, it is rotated to the second position where the lamp is held in the lampholder. The pins 5, 7 of the lamp base cause the cup to rotate on the guide plate 53 until the pins 5, 7 abut the stop 29 and a corresponding stop on the opposite side of the body. At this point the lamp base must be pressed further into the body to clear the stops, moving the cup and guide plate further into the body against the force of the springs 63, 67 and the springs in the contacts 35, 37.

Figure 5A:
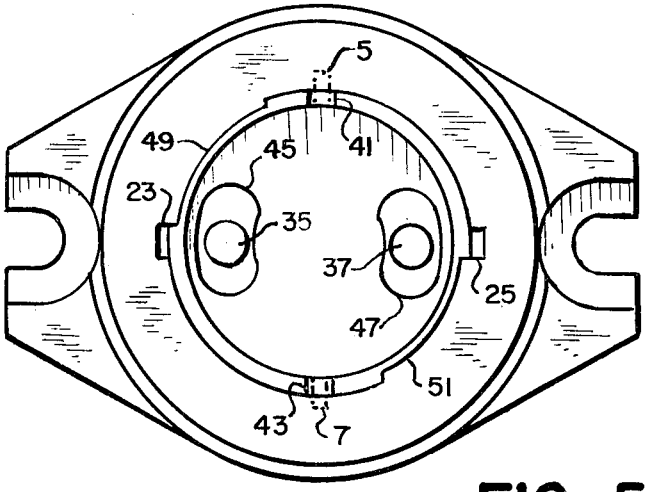
FIGS. 5*a* and 5*b* show a top view and a front view of the protective lampholder of FIGS. 1 and 2 with the insulator cup positioned to allow the application of electrical power to a lamp held in the lampholder.
Figure 5B:
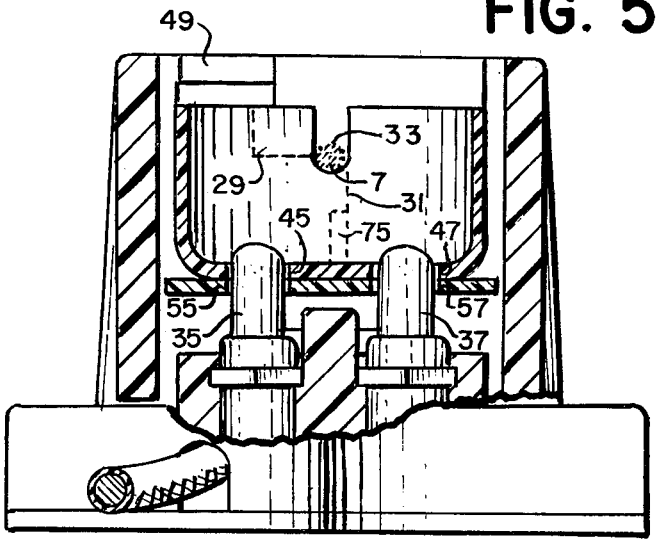

FIGS. 5*a*, 5*b* show the lampholder components after the lamp base is rotated to the operating position at which cup tabs 73,75 abut stop 31 and a corresponding stop (not shown) on the opposite side of the body. At this position the force of the above-mentioned springs causes guide plate 53 to bias the pins 5, 7 into the detents 33 and a corresponding detent (not shown) on the opposite side of the body. In this position the resiliently-loaded contacts 35, 37 spring through apertures 45, 47 in the bottom of the cup and make electrical connection with the contacts 9, 11 on the base of the lamp.

It should be noted that the portions of the contacts 35, 37 protruding through the apertures 45, 47 are rounded to facilitate camming of the contacts out of the cup by the edges of the apertures when the lamp base is rotated back to the first position for removal of the lamp.

Although the invention has been explained by use of an exemplary embodiment, it is recognized that various modifications can be made without departing from the scope of the invention as defined by the appended claims. For example, the guide plate and its associated springs could be entirely eliminated and the longitudinal position of the cup could be governed by grooves or tracks formed in the side wall of the hollow portion, into which the tabs on the cup project. In this case the lamp base pins would be biased into the detents solely by the force of the resiliently-loaded contacts. It is also possible to use an insulating member having means for engaging only one pin of the lamp base. 1

We claim:

1. A lampholder for a bayonet base lamp having pins protruding from opposite sides of the base and having electrical contacts on the bottom of the base;

said lampholder comprising a body including a hollow portion at one end and a support portion at the other end;

said hollow portion including an opening for receiving the lamp base and securing means for engaging at least one of the pins when the lamp base is inserted and rotated to an operating position; and said support portion including resiliently-loaded contacts for making electrical connection with the contacts on the lamp base when the lamp base is in the operating position;

wherein the improvement comprises:

(a) a rotatable insulating member mounted in the hollow portion of the body for interposition between an inserted lamp base and the resiliently-loaded contacts, said member including means for engaging at least one pin of the lamp base to effect rotation of the member with the lamp base and including apertures permitting the resiliently-loaded contacts to make connection with the electrical contacts of an inserted lamp base after rotation to the operating position, said member covering the resiliently-loaded contacts when the lamp base is removed from the lampholder;

(b) retaining means projecting inwardly from an inner surface of the hollow portion of the body for retaining the rotatable insulating member in the body; and (c) a resiliently-loaded guide plate disposed between the rotatable insulating member and the support portion of the body for urging said member against the retaining means and for urging at least one of the pins of an inserted lamp base into engagement with the securing means, said guide plate including openings for enabling passage of the resiliently-loaded contacts.

2. A lampholder as in claim 1 wherein said rotatable insulating member comprises an insulator cup, said means for engaging at least one pin of the lamp base to effect rotation comprising a slot in a side of the cup, and said apertures being situated in the bottom of the cup such that they always align with the contacts on the inserted lamp base, but only align with the resiliently-loaded contacts when the lamp base is rotated to the operating position.

3. A lampholder as in claim 2 wherein the insulator cup further includes an outwardly-extending tab and an inner wall of the hollow portion includes an indentation into which the tab projects, said tab and said indentation cooperating to limit movement of the insulator cup between a first position at which a lamp base is inserted into the lampholder body and a second position at which the lamp base is held in the body.

4. A lampholder as in claim 2 where the retaining means comprises inwardly-projecting retaining stops adjacent the opening in the hollow portion of the body, and where the insulator cup includes flexible portions in a sidewall thereof located along the circumference of the sidewall at positions corresponding with the positions of said retaining stops during assembly of the lampholder, said flexible portions facilitating passage of the sidewall by the retaining stops during installation of the cup into the body.

* * * * *